US012055024B2

(12) United States Patent
Guo et al.

(10) Patent No.: US 12,055,024 B2
(45) Date of Patent: Aug. 6, 2024

(54) HEAVY OIL THERMAL RECOVERY METHOD BASED ON STAGED INJECTION OF SUPERCRITICAL MULTIELEMENT THERMAL FLUID

(71) Applicant: XI'AN JIAOTONG UNIVERSITY, Shaanxi (CN)

(72) Inventors: Liejin Guo, Shaanxi (CN); Yantao Zhou, Shaanxi (CN); Qiuyang Zhao, Shaanxi (CN); Lichen Zheng, Shaanxi (CN); Yuhuan Lei, Shaanxi (CN); Yechun Wang, Shaanxi (CN); Hui Jin, Shaanxi (CN)

(73) Assignee: XI'AN JIAOTONG UNIVERSITY, Shaanxi (CN)

( * ) Notice: Subject to any disclaimer, the term of this patent is extended or adjusted under 35 U.S.C. 154(b) by 0 days.

(21) Appl. No.: 18/342,684

(22) Filed: Jun. 27, 2023

(65) Prior Publication Data

US 2023/0340865 A1 Oct. 26, 2023

Related U.S. Application Data

(63) Continuation of application No. PCT/CN2021/141793, filed on Dec. 27, 2021.

(30) Foreign Application Priority Data

Dec. 28, 2020 (CN) ..... 202011588120.X

(51) Int. Cl.
*E21B 43/243* (2006.01)

(52) U.S. Cl.
CPC ..... *E21B 43/243* (2013.01)

(58) Field of Classification Search
None
See application file for complete search history.

(56) References Cited

U.S. PATENT DOCUMENTS 4,597,441 A * 7/1986 Ware ..... E21B 43/18 166/272.3
5,211,230 A * 5/1993 Ostapovich ..... E21B 43/243 166/50

(Continued)

FOREIGN PATENT DOCUMENTS

CA 2704689 A1 11/2010
CN 102230372 A 11/2011

(Continued)

OTHER PUBLICATIONS

International Search Report dated Mar. 25, 2022 in International Application No. PCT/CN2021/141793.English translation attached.

(Continued)

*Primary Examiner* — Charles R Nold

(57) ABSTRACT

A heavy oil thermal recovery method based on a multi-composition thermal fluid in a supercritical state, comprising: injecting a mixing of steam and vacuum gas oil containing Fe(III) aromatic sulfonate dissolved therein into an subterranean formation to preheat the subterranean formation, and extracting light crude oil from the subterranean formation when a temperature of the subterranean formation reaches a required temperature for combustion of heavy oil; injecting the steam and a combustion-supporting gas into the subterranean formation to enable the heavy oil to be ignited and a temperature of the subterranean formation to be reached 600° C.; and injecting a multi-composition thermal fluid formed by mixing a hydrogen donor with water into the subterranean formation to enable the multi-composition thermal fluid to be heated to the supercritical state under heat provided by the combustion of the heavy oil, and extracting crude oil modified by the heavy oil through the multi-composition thermal fluid.

10 Claims, 1 Drawing Sheet

(56) References Cited

U.S. PATENT DOCUMENTS

| | | | | |
|---|---|---|---|---|
| 5,339,897 | A * | 8/1994 | Leaute | E21B 43/305 166/50 |
| 2003/0100451 | A1* | 5/2003 | Messier | E21B 7/04 507/100 |
| 2011/0253367 | A1 | 10/2011 | Banerjee et al. | |
| 2014/0262243 | A1 | 9/2014 | Rees et al. | |
| 2015/0114318 | A1 | 4/2015 | Zhang et al. | |

FOREIGN PATENT DOCUMENTS

| | | | |
|---|---|---|---|
| CN | 102268983 | A | 12/2011 |
| CN | 103244090 | A | 8/2013 |
| CN | 104533364 | A | 4/2015 |
| CN | 106640008 | A | 5/2017 |
| CN | 106996283 | A | 8/2017 |
| CN | 108708701 | A | 10/2018 |
| CN | 112727417 | A | 4/2021 |

OTHER PUBLICATIONS

First Office Action from corresponding Chinese Application No. 202011588120.X, dated Aug. 25, 2021. English translation attached.
Second Office Action from corresponding Chinese Application No. 202011588120.X, dated Mar. 8, 2022. English translation attached.

* cited by examiner

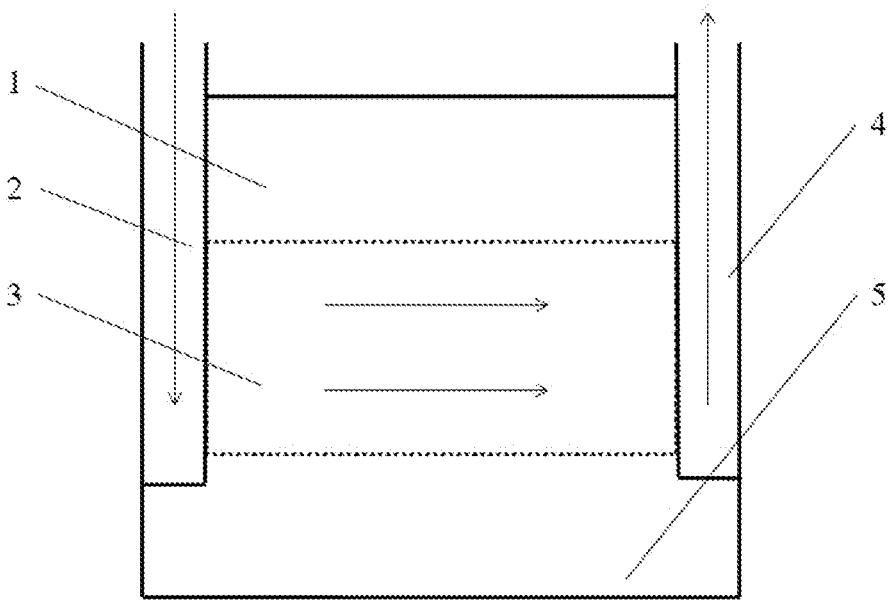
1
2
3
4
5

HEAVY OIL THERMAL RECOVERY METHOD BASED ON STAGED INJECTION OF SUPERCRITICAL MULTIELEMENT THERMAL FLUID

CROSS-REFERENCE TO RELATED APPLICATIONS

The present application is a continuation of International Application No. PCT/CN2021/141793, filed on Dec. 27, 2021, which claims priority to Chinese Patent Application No. 202011588120.X, filed on Dec. 28, 2020, both of which are incorporated herein by reference.

TECHNICAL FIELD

The present invention belongs to the field of oil extraction, and in particular, to a heavy oil thermal recovery method based on a supercritical multi-composition thermal fluid.

BACKGROUND

In the modern world, a large amount of oil resources is consumed every day. Oil is a kind of non-renewable resource, but people's demand for oil is still growing. With the consumption of light oil resources, the proportion of heavy oil in the oil resources is increasing. Especially for China, where the oil resources are scarce, heavy oil has become an important oil resource. The traditional thermal recovery technology heats the storage stratum to reduce the viscosity of heavy oil, which can only temporarily reduce the viscosity of heavy oil. Therefore, the stratum needs to be continuously heated to maintain a high-temperature state. In addition, the subsequent transportation of heavy oil still requires a lot of energy, resulting in the problems of low production efficiency, unsatisfactory viscosity reduction efficiency, unsatisfactory energy efficiency, etc.

SUMMARY

An object of the present invention is to provide a heavy oil thermal recovery method based on a multi-composition thermal fluid in a supercritical state, to overcome the defects in the prior art.

In order to achieve the above object, the present invention adopts the following technical solution.

A heavy oil thermal recovery method based on a multi-composition thermal fluid in a supercritical state includes the following steps:

S1, injecting a mixing of steam and vacuum gas oil containing Fe(III) aromatic sulfonate dissolved therein into an subterranean formation to preheat the subterranean formation, and extracting light crude oil from the subterranean formation until a temperature of the subterranean formation reaches a required temperature for combustion of heavy oil, where the required temperature for the combustion of the heavy oil is 320° C.;

S2, injecting the steam and a combustion-supporting gas into the subterranean formation to enable the heavy oil to be ignited and a temperature of the subterranean formation to be reached 600° C.; and S3, injecting a multi-composition thermal fluid formed by mixing a hydrogen donor with water into the subterranean formation to enable the multi-composition thermal fluid to be heated to the supercritical state under heat provided by the combustion of the heavy oil, and extracting crude oil modified by the heavy oil through the multi-composition thermal fluid, wherein the multi-composition thermal fluid in the supercritical state has a temperature higher than 374° C., and a pressure higher than 22.1 MPa.

Further, the method further includes: injecting a thermal fluid having steam and a catalyst into the subterranean formation to enable the subterranean formation to be heated to the ignition temperature or higher; and injecting a thermal fluid having steam and a combustion-supporting gas to enable the heavy oil to be combusted and the temperature of the subterranean formation to be increased.

Further, the multi-composition thermal fluid used includes a mixture of water, a catalyst, and a hydrogen donor.

Further, the method further includes: repeatedly injecting, when the temperature of the subterranean formation is lower than a requiring temperature of a modification reaction, the thermal fluid having steam and the catalyst to enable the temperature of the subterranean formation to be heated to the ignition temperature, then injecting steam and combustion-supporting gas to ignite the heavy oil to increase the temperature of subterranean formation to the requiring temperature of the modification reaction.

Further, a combustion-supporting gas used includes air, enriched oxygen, or pure oxygen.

Further, the catalyst includes a water-soluble salt, an oil-soluble salt or nanoparticles of a transition metal.

Further, the hydrogen donor includes tetralin, formic acid, methyl formate, dihydroanthracene, alcohols and naphthenic straight-run diesel, CO, or $CH_4$.

Further, the water is injected in a state as mixture of low-temperature water, water vapor, or supercritical water.

Further, an injection well and an extraction well are formed as a single well, or the injection well and the extraction well are disposed separately.

Compared with the prior art, the present invention has the following beneficial effects.

According to the heavy oil thermal recovery method based on the multi-composition thermal fluid in the supercritical state of the present invention, the mixing of steam and vacuum gas oil containing Fe(III) aromatic sulfonate dissolved therein is injected into an subterranean formation to preheat the subterranean formation, and the light crude oil is extracted from the subterranean formation until a temperature of the subterranean formation reaches a required temperature for combustion of heavy oil; the steam and a combustion-supporting gas is injected into the subterranean formation to enable the heavy oil to be ignited and a temperature of the subterranean formation to be reached 600° C.; and the multi-composition thermal fluid formed by mixing a hydrogen donor with water is injected into the subterranean formation to enable the multi-composition thermal fluid to be heated to the supercritical state under heat provided by the combustion of the heavy oil, and the crude oil modified by the heavy oil is extracted through the multi-composition thermal fluid, where the multi-composition thermal fluid in the supercritical state has a temperature higher than 374° C. and a pressure higher than 22.1 MPa. Reaction temperature is increased by heat released by the crude oil during combustion, and a supercritical state of water is reached, such that load of a ground heating device can be reduced. Use of the underground heavy oil which is difficult to extract as fuel realizes the purposes of fully utilizing heavy oil resources and saving energy. The addition of a catalyst can promote the reaction of the multi-composition thermal fluid in the supercritical state, and therefore, when the temperature of the supercritical water drops below a critical point in partial regions at certain time points, the catalyst can ensure that an hydrothermal cracking reaction is continuously and efficiently carried out, thereby improving the modification effect and expanding the modification reaction sweep region. The heavy oil thermal recovery method based on the multi-composition thermal fluid in the supercritical state of the present invention has a higher reaction efficiency, a better reaction effect and the catalytic activity, can supplement heat through in-situ heating, makes full use of the underground heavy oil resource, and can reduce a carbon deposit.

Further, when the temperature of the subterranean formation is lower than the required temperature for the combustion of the heavy oil, the steam is repeatedly injected to enable the temperature of the subterranean formation to enable the heavy oil to be combusted. Heat released by the crude oil in the subterranean formation during combustion is fully used, such that the load of external heating can be reduced.

Further, the multi-composition thermal fluid is doped with a combustion-supporting gas, facilitating combustion and heating.

Further, the water is injected in a state as a mixture of low-temperature water, water vapor, or supercritical water. When the water enters a supercritical state, oxygen can be mutually soluble with the supercritical water, showing strong oxidizability, such that a reaction between the heavy oil and the oxygen can be promoted.

BRIEF DESCRIPTION OF DRAWINGS

FIG. 1 is a schematic diagram illustrating a well placing structure in an embodiment of the present invention.

In the FIGURE: 1, cover stratum; 2, injection well; 3, subterranean formation; 4, extraction well; and 5, understratum.

DESCRIPTION OF EMBODIMENTS

The present invention will be further described in detail below with reference to the accompanying drawings:

A heavy oil thermal recovery method based on staged injection of a supercritical multielement thermal fluid includes the following steps.

A heavy oil thermal recovery method based on a multi-composition thermal fluid in a supercritical state includes the following steps.

At S1, a mixing of steam and vacuum gas oil containing Fe(III) aromatic sulfonate dissolved therein is injected into an subterranean formation to preheat the subterranean formation, and light crude oil is extracted from the subterranean formation until a temperature of the subterranean formation reaches a required temperature for combustion of heavy oil, where the required temperature for the combustion of the heavy oil is 320° C.

Specifically, a thermal fluid formed by steam and a catalyst is injected into the subterranean formation, to enable the subterranean formation to be heated to the ignition temperature of heavy oil or higher.

At S2, the steam and a combustion-supporting gas is injected into the subterranean formation to enable the heavy oil to be ignited and a temperature of the subterranean formation to be reached 600° C.

At S3, a multi-composition thermal fluid formed by mixing a hydrogen donor with water is injected into the subterranean formation to enable the multi-composition thermal fluid to be heated to the supercritical state under heat provided by the combustion of the heavy oil, and extracting crude oil modified by the heavy oil through the multi-composition thermal fluid, wherein the multi-composition thermal fluid in the supercritical state has a temperature higher than 374° C., and a pressure higher than 22.1 MPa.

The process that heavy oil in the subterranean formation which has reached the ignition temperature is ignited to increase the temperature of the subterranean formation, forms the underground combustion and heating stage, in which the heavy oil in the stratum is combusted to increase the temperature of the subterranean formation.

The multi-composition thermal fluid used in the supercritical hydrogen-donated modification stage is a mixture of water, a catalyst, and a hydrogen donor. After the multi-composition thermal fluid is injected into the subterranean formation, the water in the multi-composition thermal fluid is heated by the high-temperature stratum to reach the supercritical state, and the heavy oil is extracted after being modified under the action of the supercritical water, the catalyst and the hydrogen donor, thereby improving the crude oil recovery efficiency.

When the temperature of the subterranean formation is lower than a requiring temperature of a modification reaction, a thermal fluid formed by steam and a catalyst is repeatedly injected to enable the temperature of the subterranean formation to reach the ignition temperature, then the steam and combustion-supporting gas is injected to ignite the heavy oil to heated the subterranean formation to reach the requiring temperature of the modification reaction.

The multi-composition thermal fluid is doped with a combustion-supporting gas, and the combustion-supporting gas is air, enriched oxygen, or pure oxygen.

The water is low-temperature water, water vapor, or supercritical water. The catalyst is a water-soluble salt, an oil-soluble salt or nanoparticles of a transition metal, which can effectively reduce the activation energy of the modification reaction and increase the reaction rate. The hydrogen donor is tetralin, formic acid, methyl formate, dihydroanthracene, alcohols and naphthenic straight-run diesel, CO, or CH4.

In the initial extraction and preheating stage, the thermal fluid is formed by steam and the catalyst, with the main purpose to heat the stratum and extract the light crude oil. In the underground combustion and heating stage, the thermal fluid with the combustion-supporting gas reacts with residual heavy oil in the subterranean formation for combustion, such that the temperature of the subterranean formation is increased, and the water may be gradually transformed from steam or hot water into the supercritical state. In the supercritical hydrogen-donated modification stage, the hydrogen donor is mixed in the multi-composition thermal fluid. When entering the underground high-temperature oil stratum, the low-temperature water may be heated up and transformed into the supercritical state. Finally, the crude oil, the catalyst, the hydrogen donor, and the supercritical water may undergo a modification reaction that is greatly improved in effect compared with that in the first stage. In addition, due to heat absorption of the modification reaction and heat dissipation of the stratum, the underground combustion and heating stage and the supercritical hydrogen-donated modification stage may be repeated according to the actual situation, to achieve an optimal oil recovery effect.

The reaction temperature of the multi-composition thermal fluid is increased by the heat released by the crude oil during combustion, and the supercritical state of water is reached, such that the load of a ground heating device can be reduced. Use of the underground heavy oil which is difficult to extract as a fuel may realize the purposes of fully utilizing heavy oil resources and saving energy. The CO produced by insufficient combustion may undergo a hydrothermal replacement reaction to produce H2, which may be used as a hydrogen donor in the third stage. With the rise of the temperature of the stratum, when the water enters the supercritical state, the oxygen can be mutually soluble with the supercritical water, showing strong oxidizability, such that a reaction between the heavy oil and the oxygen can be promoted. Supercritical water has the advantages of good diffusivity, capability of dissolving crude oil, high reaction activity, and the like. Research shows that the viscosity reduction effect of the water in the supercritical state on the heavy oil is greatly improved compared with that of the water in a subcritical state, and a carbon deposit is greatly reduced. In combination with the use of the catalyst and the hydrogen donor, the efficiency and the effect of the supercritical water modification reaction can further be improved. Similarly, the yield of heavy products may further be reduced, and the yield of light products may further be increased. Once the crude oil is converted to the carbon deposit, the crude oil cannot be extracted to the ground, which may also lead to channel blockage in the stratum. Therefore, the supercritical hydrogen-donated oil recovery method in the method provided by the present invention has a higher efficiency and a better effect than the traditional technology. Meanwhile, the addition of the catalyst can promote the reaction of the multi-composition thermal fluid in the supercritical state, and therefore, when the temperature of the supercritical water drops below a critical point in partial regions at certain time points, the catalyst can ensure that an aqueous pyrolysis reaction is continuously and efficiently carried out, thereby improving the modification effect and expanding the modification reaction sweep region. Therefore, the heavy oil thermal recovery method based on the multi-composition thermal fluid in the supercritical state of the present invention has a higher reaction efficiency, a better reaction effect and the catalytic activity, can supplement heat through self-heating, makes full use of the underground heavy oil resources, has a larger sweep region, and can reduce the carbon deposit.

Embodiment

As shown in FIG. 1, a heavy oil thermal recovery system based on a multi-composition thermal fluid in the supercritical state suitable for the afore-mentioned method is provided. The system includes an injection well 2 in communication with an subterranean formation 3. The injection well 2 is provided with a sealed well-killing device therein. The injection well may be used as an independent injection well, or may double as an extraction well. The injection well and the extraction well may be two independent shafts, so as to allow simultaneous oil extraction and injection operations. Above the subterranean formation 3 is a cover stratum 1, and below the subterranean formation 3 is an understratum 5.

The subterranean formation has a low initial temperature which cannot meet the requirements for injecting air for combustion, and some crude oil may be lighter. In the first stage, water vapor and vacuum gas oil containing Fe(III) aromatic sulfonate dissolved therein are mixed to form a thermal fluid by means of a nozzle or other devices. The thermal fluid is injected into the subterranean formation 3 through the injection well 2, and the temperature of the subterranean formation 3 begins to rise. The Fe(III) aromatic sulfonate in vacuum gas oil is mixed and mutually dissolved with the crude oil, and then Fe(III) aromatic sulfonate is dissolved in the crude oil. Under the action of the catalyst and the water vapor, the crude oil undergoes a modification reaction to produce light products, and the viscosity of the crude oil is reduced, and finally, the crude oil with the reduced viscosity is extracted from the extraction well 4, and the temperature of the subterranean formation 3 is increased to a value required for combustion in the second stage. In this process, there are heat losses from the subterranean formation 3 to the cover stratum 1 and the understratum 5 inevitably. However, it is possible to ensure the initial temperature of the thermal fluid and the injection time to achieve the purposes of initial extraction and preheating. In the second stage, the extraction well 4 is closed, and the water vapor and air are mixed and in turn, injected into the subterranean formation 3 through the injection well 2. A combustion reaction proceeds between air and the remaining crude oil that is difficult to be extracted by the conventional modification method in the first stage in the subterranean formation 3, and the temperature and pressure of the subterranean formation 3 are further increased to exceed critical points (374° C., 22.1 MPa). At this time, oxygen and the crude oil may both be dissolved into the supercritical water, and react more quickly and fully in the dissolved state, and finally the temperature of the subterranean formation reaches 600° C. Here, it needs to select an air injection rate and a ratio of the multi-composition thermal fluid according to the actual situation. The amount of oxygen should be insufficient as insufficient combustion may produce CO, which in tum produces H2. After the injection of the multi-composition thermal fluid in the second stage is stopped, the well is closed for a period of time to exhaust oxygen. In the third stage, the multi-composition thermal fluid formed by mixing the water vapor with methane is injected. After the water vapor is injected into the subterranean formation 3, the temperature and the pressure are increased to exceed critical points (374° C., 22.1 MPa) to form the multi-composition thermal fluid in the supercritical state, and methane may undergo a hydrothermal replacement reaction to produce H2. Under the action of Fe(III) aromatic sulfonate, H2, and supercritical water dissolved in the crude oil, the crude oil undergoes a modification reaction with the efficiency greatly improved, and the yield of light products is increased, and the yield of heavy products is reduced. Finally, the modified crude oil is extracted from the extraction well 4 by the displacement of the supercritical water, CO2 and the like. It is to be noted that if a catalyst is used in the first stage, the catalyst may be used or not used in the third stage, because the efficiency of the reaction in the third stage may be high even without the catalyst, but the addition of the catalyst can increase the reaction sweep range. With the heat absorption of the modification reaction and the heat dissipation of the subterranean formation 3 to the cover stratum 1, the temperature may drop below the critical point when the crude oil is completely extracted. At this time, the second stage and the third stage can be repeated.

What is claimed is:

1. A heavy oil thermal recovery method based on a multi-composition thermal fluid in a supercritical state, comprising:

S1, injecting a mixing of steam and vacuum gas oil containing Fe(III) aromatic sulfonate dissolved therein into an subterranean formation to preheat the subterranean formation, and extracting light crude oil from the subterranean formation until a temperature of the subterranean formation reaches a required temperature for combustion of heavy oil, wherein the required temperature for the combustion of the heavy oil is 320° C.;

S2, injecting the steam and a combustion-supporting gas into the subterranean formation to enable the heavy oil to be ignited and a temperature of the subterranean formation to be reached 600° C.; and S3, injecting a multi-composition thermal fluid formed by mixing a hydrogen donor with water into the subterranean formation to enable the multi-composition thermal fluid to be heated to the supercritical state under heat provided by the combustion of the heavy oil, and extracting crude oil modified by the heavy oil through the multi-composition thermal fluid, wherein the multi-composition thermal fluid in the supercritical state has a temperature higher than 374° C. and a pressure higher than 22.1 MPa.

2. The heavy oil thermal recovery method based on the multi-composition thermal fluid in the supercritical state according to claim 1, further comprising:

injecting a thermal fluid having steam and a catalyst into the subterranean formation to enable the subterranean formation to be heated to the ignition temperature of the heavy oil or higher; and injecting a thermal fluid having steam and a combustion-supporting gas to enable the subterranean formation to be combusted and the temperature of the subterranean formation to be increased.

3. The heavy oil thermal recovery method based on the multi-composition thermal fluid in the supercritical state according to claim 1, wherein the multi-composition thermal fluid comprises a mixture of water, a catalyst, and a hydrogen donor.

4. The heavy oil thermal recovery method based on the multi-composition thermal fluid in the supercritical state according to claim 2, further comprising:

repeatedly injecting, when the temperature of the subterranean formation is lower than a requiring temperature of a modification reaction, the thermal fluid having the steam and the catalyst to enable the subterranean formation to be ignited and the temperature of the subterranean formation to be reached to the requiring temperature of the modification reaction.

5. The heavy oil thermal recovery method based on the multi-composition thermal fluid in the supercritical state according to claim 2, wherein the multi-composition thermal fluid is doped with a combustion-supporting gas.

6. The heavy oil thermal recovery method based on the multi-composition thermal fluid in the supercritical state according to claim 5, wherein the combustion-supporting gas comprises air, enriched oxygen, or pure oxygen.

7. The heavy oil thermal recovery method based on the multi-composition thermal fluid in the supercritical state according to claim 2, wherein the catalyst comprises a water-soluble salt, an oil-soluble salt, or nanoparticles of a transition metal.

8. The heavy oil thermal recovery method based on the multi-composition thermal fluid in the supercritical state according to claim 2, wherein the hydrogen donor comprises tetralin, formic acid, methyl formate, dihydroanthracene, alcohols and naphthenic straight-run diesel, CO, or $CH_4$.

9. The heavy oil thermal recovery method based on the multi-composition thermal fluid in the supercritical state according to claim 2, wherein the water is injected in a state as a mixture of low-temperature water, water vapor, or supercritical water.

10. The heavy oil thermal recovery method based on the multi-composition thermal fluid in the supercritical state according to claim 1, wherein an injection well and an extraction well are formed as a single well, or the injection well and the extraction well are disposed separately.

* * * * *